US010377051B2

(12) United States Patent
Bozikis et al.

(10) Patent No.: US 10,377,051 B2
(45) **Date of Patent: *Aug. 13, 2019**

(54) SHAVING BLADE CARTRIDGE AND A SHAVER COMPRISING SUCH SHAVING BLADE CARTRIDGE

(71) Applicant: BIC-VIOLEX S.A., Anixi (GR)

(72) Inventors: Ioannis Bozikis, Koukaki-Athens (GR); Georgios Georgakis, Melisia (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

This patent is subject to a terminal disclaimer.

(21) Appl. No.: 15/511,281

(22) PCT Filed: Oct. 19, 2015

(86) PCT No.: PCT/EP2015/074184

§ 371 (c)(1),
(2) Date: Mar. 15, 2017

(87) PCT Pub. No.: WO2016/062675

PCT Pub. Date: Apr. 28, 2016

(65) Prior Publication Data

US 2017/0282385 A1 Oct. 5, 2017

Related U.S. Application Data

(60) Provisional application No. 62/065,857, filed on Oct. 20, 2014.

(51) Int. Cl.
*B26B 21/40* (2006.01)

(52) U.S. Cl.
CPC ..... *B26B 21/4031* (2013.01); *B26B 21/4043* (2013.01)

(58) Field of Classification Search
CPC ..... B26B 21/4043; B26B 21/4018; B26B 21/521; B26B 21/22; B26B 21/222;
(Continued)

(56) References Cited

U.S. PATENT DOCUMENTS 6,276,061 B1 8/2001 Rozenkranc
2005/0022386 A1 2/2005 Macove
(Continued)

FOREIGN PATENT DOCUMENTS

CA 2937358 A1 * 9/2015 ..... B26B 21/227
WO WO 2005/011930 A1 2/2005
(Continued)

OTHER PUBLICATIONS

International Search Report of PCT/EP2015/074184 dated Jan. 14, 2016.

*Primary Examiner* — Ghassem Alie
(74) *Attorney, Agent, or Firm* — Polsinelli PC

(57) ABSTRACT

A shaving blade cartridge includes a housing having first and second longitudinal sides extending between top and bottom sides. A primary cutting blade is mounted on the housing and has a cutting edge. A primary cap is located rearward of the cutting edge. A trimming element includes a trimming edge, the trimming edge and the cutting edge being opposite. A trimming guard bar includes a trimming guard bar edge. The trimming edge, the trimming guard bar edge, and a tangent to the trimming guard bar in the vicinity of the trimming guard bar edge define a theoretical limit trimming curve which is concave when viewed in relation to the trimming guard bar. The trimming guard bar is disposed behind and/or tangential to the theoretical limit trimming curve toward the second longitudinal side, such that the trimming guard bar does not project beyond the theoretical limit trimming curve.

15 Claims, 12 Drawing Sheets

(58) Field of Classification Search
CPC ... B26B 21/225; B26B 21/40; B26B 21/4037; B26B 21/4012; B26B 21/4031; B26B 21/4025; Y10T 29/49826
USPC ..... 30/34.1, 50, 526, 346.5
See application file for complete search history.

(56) References Cited

U.S. PATENT DOCUMENTS

| | | | | |
|---|---|---|---|---|
| 2008/0010833 | A1 | 1/2008 | Rawle | |
| 2010/0011548 | A1* | 1/2010 | Rudduck | B62D 27/00 24/604 |
| 2010/0299928 | A1* | 12/2010 | Clarke | B26B 21/4018 30/34.1 |
| 2011/0023305 | A1* | 2/2011 | Whelan | B26B 21/227 30/34.1 |
| 2016/0354940 | A1* | 12/2016 | Bozikis | B26B 21/227 |

FOREIGN PATENT DOCUMENTS

| | | | |
|---|---|---|---|
| WO | WO 2005/090022 | A2 | 9/2005 |
| WO | WO 2011/017239 | A1 | 2/2011 |
| WO | WO 2013/187692 | A1 | 12/2013 |
| WO | WO 2015/006079 | A1 | 1/2015 |
| WO | WO 2015/127879 | A1 | 9/2015 |

* cited by examiner

SHAVING BLADE CARTRIDGE AND A SHAVER COMPRISING SUCH SHAVING BLADE CARTRIDGE

CROSS-REFERENCE TO RELATED APPLICATIONS

This application is a national stage application of International Application No. PCT/EP2015/074184, filed Oct. 19, 2015, which claims priority to U.S. Provisional Application No. 62/065,857, filed Oct. 20, 2014, where the entire contents of each application is incorporated herein by reference.

FIELD OF THE INVENTION

The embodiments of the present invention relate to a shaving blade cartridge, and a shaver that has such shaving blade cartridge.

More particularly, the embodiments of the present invention also relate to the design of a shaving blade cartridge, and more specifically to the design of a trimming element at the rear of the shaving blade cartridge. The shaving blade cartridge according to the invention introduces a shaving curve that overcomes the design limitations of contemporary shaving blade cartridges and offers better shaving and trimming precision.

Trimming blade or trimming element allows for a better shaving of skin areas constricted by adjacent protruding facial features, for example skin areas situated under the nose, near the ears, and the same. Thus trimming shaving is the shaving of skin areas constricted by adjacent protruding facial features with a trimming element. The trimming shaving allows for precision shaving.

BACKGROUND OF THE INVENTION

Document WO2005011930 recites a shaving blade cartridge with a trimming assembly. More particularly, FIG. 1 illustrates the shaving blade cartridge of document WO2005011930 including a trimming assembly. The trimming assembly includes a trimming blade with a blade edge. The shaving blade cartridge is provided with a trimming guard bar and a trimming cap. The trimming guard bar and the trimming cap define a trimming plane t2. This trimming plane t2 is tangential to the trimming guard bar and the trimming cap. In other words, this trimming plane t2 is tangential to the skin contacting surfaces of the shaving blade cartridge which are in front of and behind the trimming edge. The skin contacting parts are the leading surface (corresponding to the surface of the trimming guard bar) and the trailing surface (which correspond to the surface of the trimming cap). However, the layout of the trimming assembly does not allow for precise shaving trimming, and in particular shaving trimming which precisely follows the skin of the user.

The embodiments of the present invention have objectives to mitigate the drawbacks discussed above. The manufacture of the present shaving blade cartridge is simpler, without complex guard bar and cap design, while increasing the shaving-trimming quality.

SUMMARY OF THE INVENTION

To this aim, a shaving blade cartridge according to the present invention allows for the definition of a shaving curve in the vicinity of the trimming element. More particularly, the present shaving cartridge is not provided with any trailing surface, or any leading surface. The absence of a leading and trailing surface allows the user to have such a shaving blade cartridge to use the trimming element (and more precisely the trimming blade) with a motion according to a trimming curve instead of a shaving-trimming plane. The trimming curve can be of different curvatures or radius and allows for following of the skin areas for which the trimming blade is used. For instance, the shape of the shaving blade cartridge allows the user to use the trimming blade according to a plurality of trimming curves depending on each user and on each skin areas curvatures.

In other words, the shape of the shaving blade cartridge allows for the definition of a theoretical limit trimming curve. The trimming curves that the user may use are in a range of curves. The minimum trimming curve of the range of curves is defined by the theoretical limit trimming curve. This means that from all possible trimmer curves present to the user when trimming, the theoretical limit trimming curve is defined by the boundaries set by the guard bar, the trimming edge, and the trimming guard bar edge. The term "trimming guard bar edge" is understood as being an extremity of the trimming guard bar or a surface located at an extremity of the trimming guard bar. The trimming guard bar edge is not necessarily a sharp edge.

Other characteristics and advantages of the embodiments of the present invention will readily appear from the following description of several embodiments, provided as non-limitative examples, and shown in the accompanying drawings.

BRIEF DESCRIPTION OF THE DRAWINGS

On the different figures, the same reference signs designate like or similar elements.

DETAILED DESCRIPTION OF THE INVENTION

Figure 1:
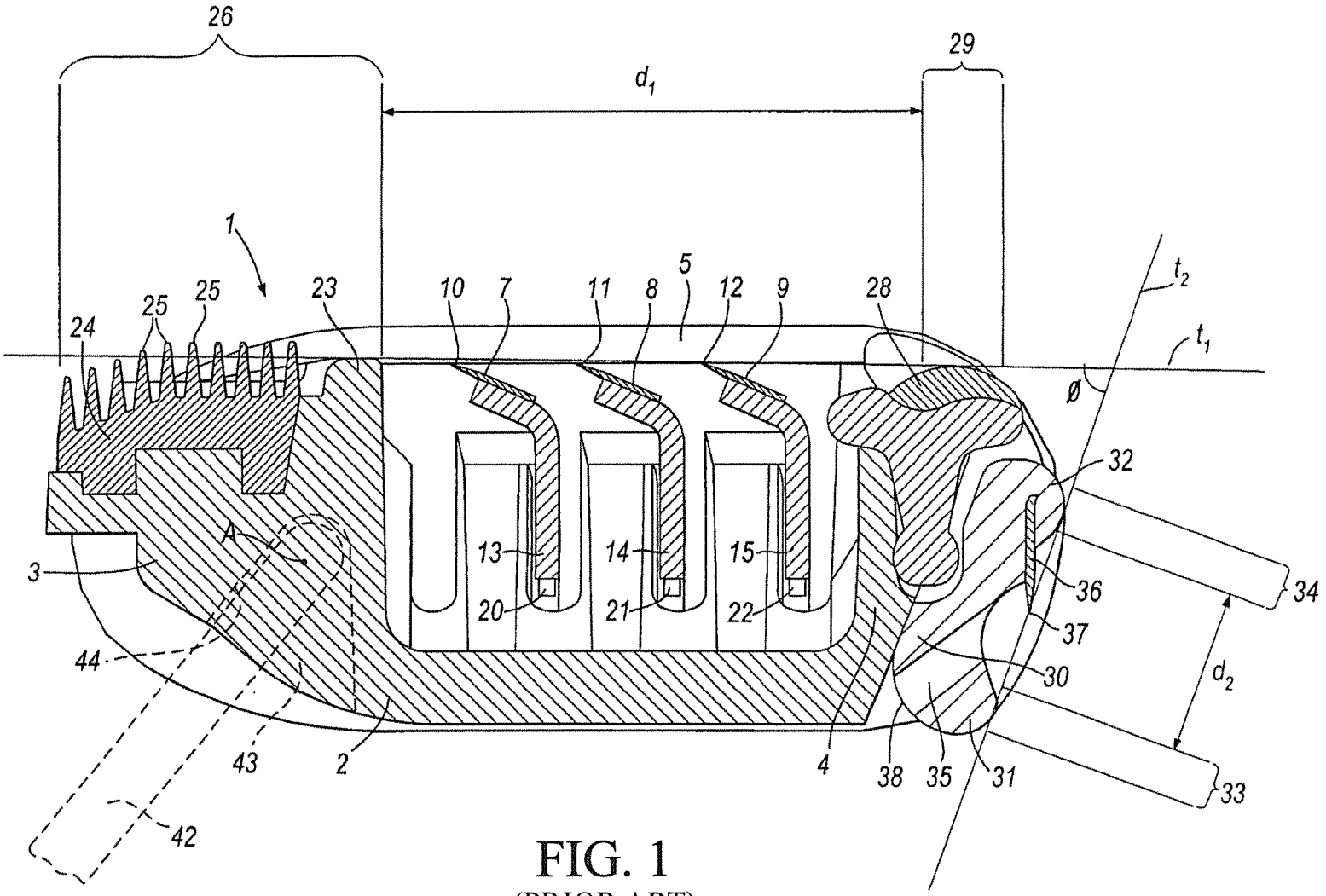
FIG. 1 (PRIOR ART)
FIG. 1 is a cross sectional view of a shaving blade cartridge according to the prior art.
Figure 2:
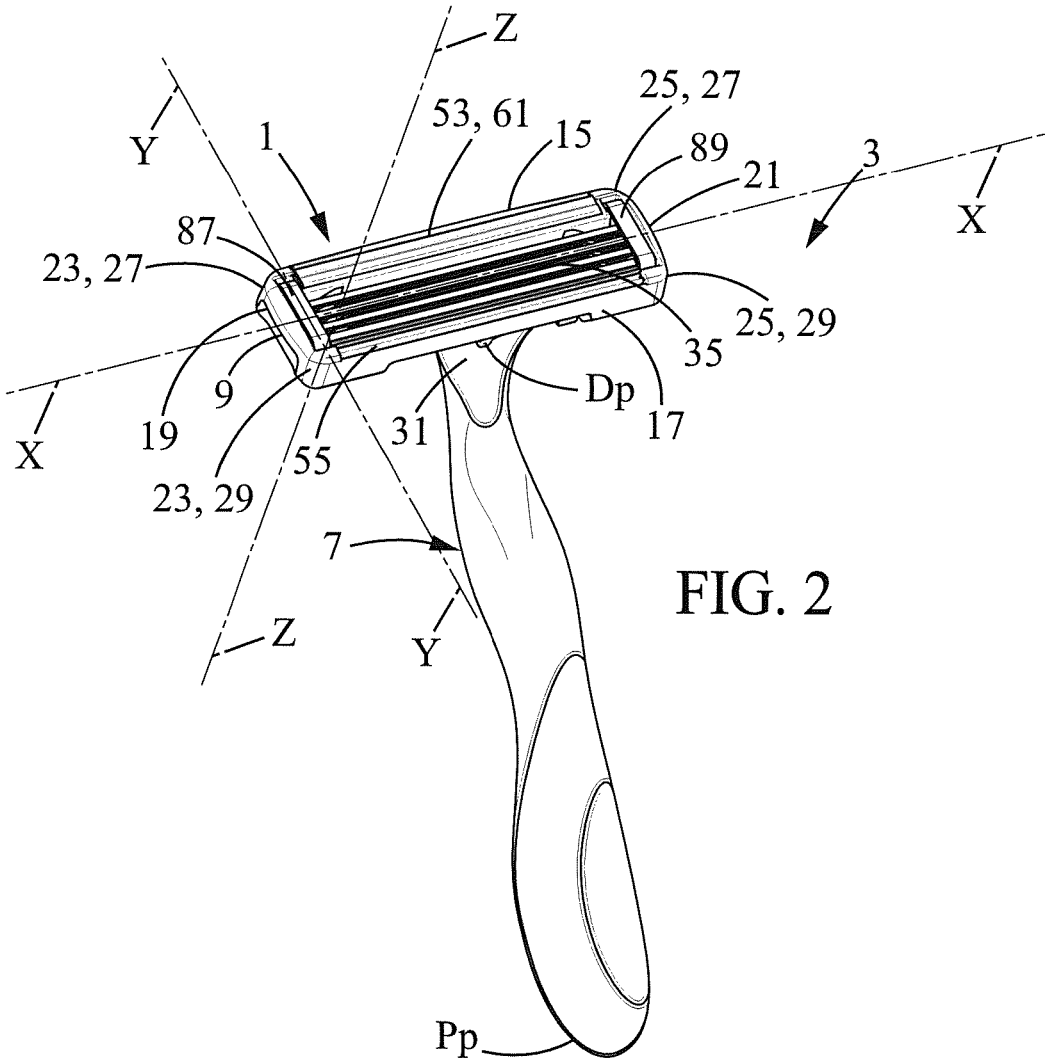
FIG. 2 is a perspective view of a shaver according to an embodiment of the present invention.

FIG. 2 shows a wet razor 3 including a shaving blade cartridge 1 according to the present invention. The shaving blade cartridge 1 is adapted to be attached to a handle 7 to form the wet razor 3 as illustrated on FIG. 2. The shaving blade cartridge 1 is provided with one or more primary cutting blades 5, as illustrated in FIGS. 3*a*, 3*b*, 4, 5, 6*a*, 6*b*, 6*c*, 10 and 12. The primary cutting blades 5 are not driven by a motor relative to the shaving blade cartridge 1.

As seen on FIG. 2, the shaving blade cartridge 1 can be attached to a handle 7 extending in a handle direction between a proximal portion Pp and a distal portion Dp. The handle 7 can pivot with regard to the shaving blade cartridge 1. The handle can pivot with regard to the shaving blade cartridge 1 from a rest position, in which the handle is free of constraints toward two opposite directions. In another embodiment of the present invention, the handle can pivot from a rest position toward one sole direction. The handle 7 can pivot with regard to the shaving blade cartridge 1 around a pivot axis P' (represented in FIG. 3*a*). In other embodiments of the present invention, the handle 7 may also be fixed with regard to the shaving blade cartridge 1. The handle direction may be curved or include one or more than one straight portions. The shaving blade cartridge 1 can, for example, be releasably connected to the handle 7 through a lock-and-release mechanism as detailed hereafter.

The user can change the orientation of the shaving blade cartridge 1, for example by turning the handle.

As depicted on the figures, the shaving blade cartridge 1 comprises a housing 9. The housing 9 extends along a longitudinal axis X-X. Viewed from the top, the housing 9 has a rectangular general shape. However, in some embodiments of the present invention, the general shape of the housing 9 may be different, and for example the housing 9 could have an oval shape, a square shape, or a circular shape. The housing 9 includes a top side 11, a bottom side 13 opposite to the top side 11 and a first and second longitudinal side 15, 17. For example, the bottom side 13 is adapted to be arranged in front of the handle 7, whereas the top side 11 is arranged opposite to the bottom side 13. The top side 11 and the bottom side 13 can be parallel to each other.

As best seen on FIG. 2, the first longitudinal side 15 extends along the longitudinal axis X-X. The second longitudinal side 17 and the first longitudinal side 15 are facing each other. The second longitudinal side 17 may be approximately parallel to the first longitudinal side 15, especially when the first and second longitudinal sides 15, 17 are flat. However, the first and second longitudinal sides 15, 17 can also have subtle or noticeable opposing inclinations. The first and second longitudinal sides 15, 17 can also have curved surfaces. The second longitudinal side 17 also extends along the longitudinal axis X-X. The first and the second longitudinal side 15, 17 each extends in a lateral direction Z along a lateral axis Z-Z, between the top side 11 and the bottom side 13 of the housing 9. The lateral axis Z-Z intersects the longitudinal axis X-X. For example, the longitudinal axis X-X and the lateral axis Z-Z may be orthogonal to each other.

The housing 9 may also include, as best seen in FIGS. 2 and 6*a*, 6*b*, 6*c*, first and second lateral sides 19, 21 which extend between the first and second longitudinal sides 15, 17, along a transversal axis Y-Y. The transversal axis Y-Y is transverse to the longitudinal axis X-X. The transversal axis Y-Y can be, for example, orthogonal to the longitudinal axis X-X and to the lateral axis Z-Z. The first and second lateral sides 19, 21 are arranged, in the lateral direction Z, between the top side 11 and the bottom side 13. The first and second lateral and longitudinal sides 15, 17, 19, 21 together form the external surface of the housing 9.

The first and second lateral sides 19, 21 both join the longitudinal ends 23, 25 of the first and second longitudinal sides 15, 17. In a similar way, the first and second longitudinal sides 15, 17 both join the free ends 27, 29 of the first and second lateral sides 19, 21. The housing 9 can be made with a plastic material. However, other materials could be used. For example, the housing could include a metallic material. Moreover, the housing can be made with a combination of two or more different materials. For example, a part of the housing may be made with a first material, whereas the other part of the housing is made with a second material.

The housing 9 can for example include, on the bottom side 13, a connection mechanism 31 adapted to connect to the handle 7. The connection mechanism 31 can thus allow the release and/or the attachment of the shaving blade cartridge 1 to the handle 7.

Figure 3A:
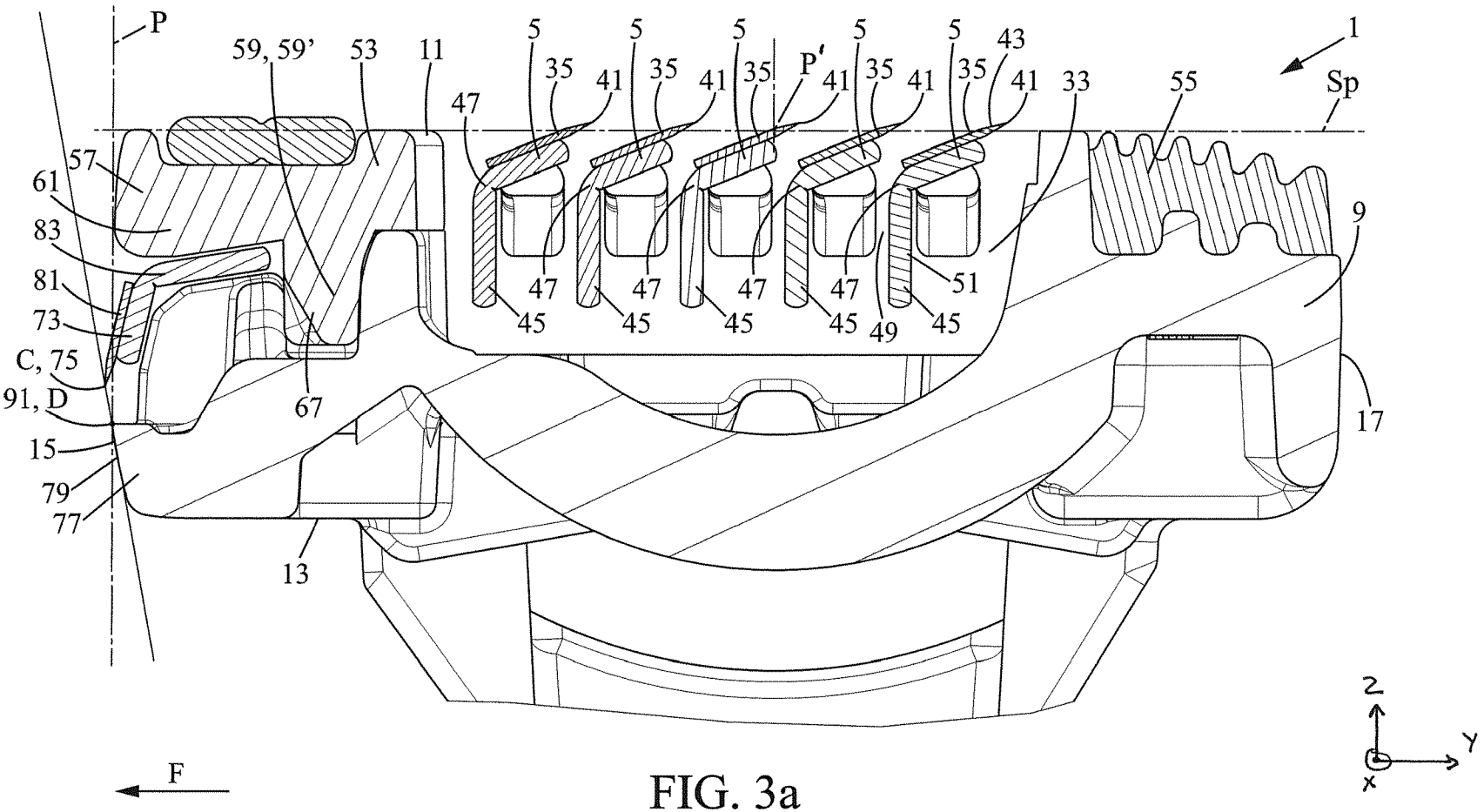
FIG. 3*a* is a cross sectional view of a shaving blade cartridge of the shaver of FIG. 2.
Figure 3B:
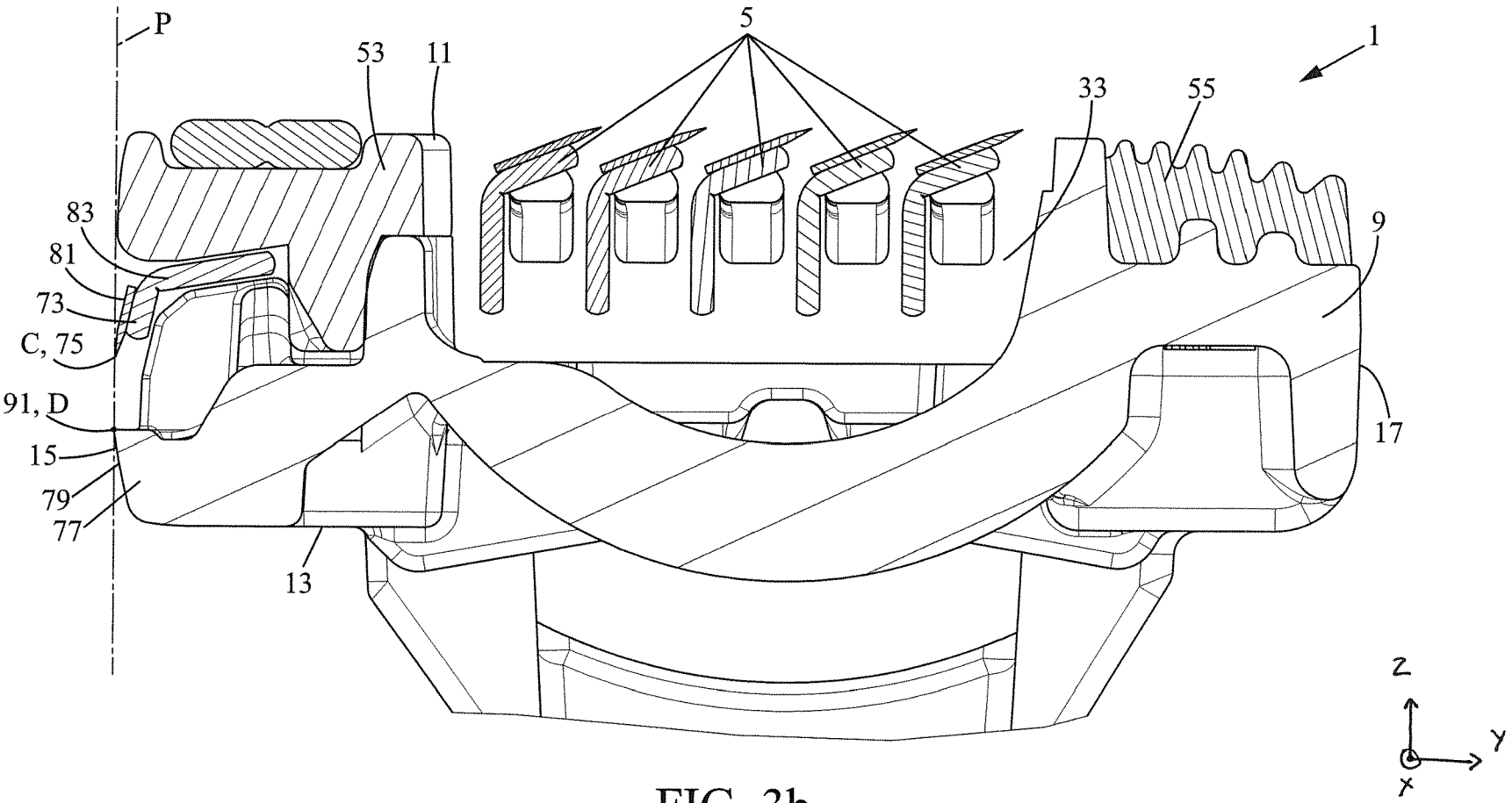
FIG. 3*b* is a cross sectional view of a shaver blade cartridge according to an embodiment of the present invention including a trimming blade having a negative trimming blade location.
Figure 4:
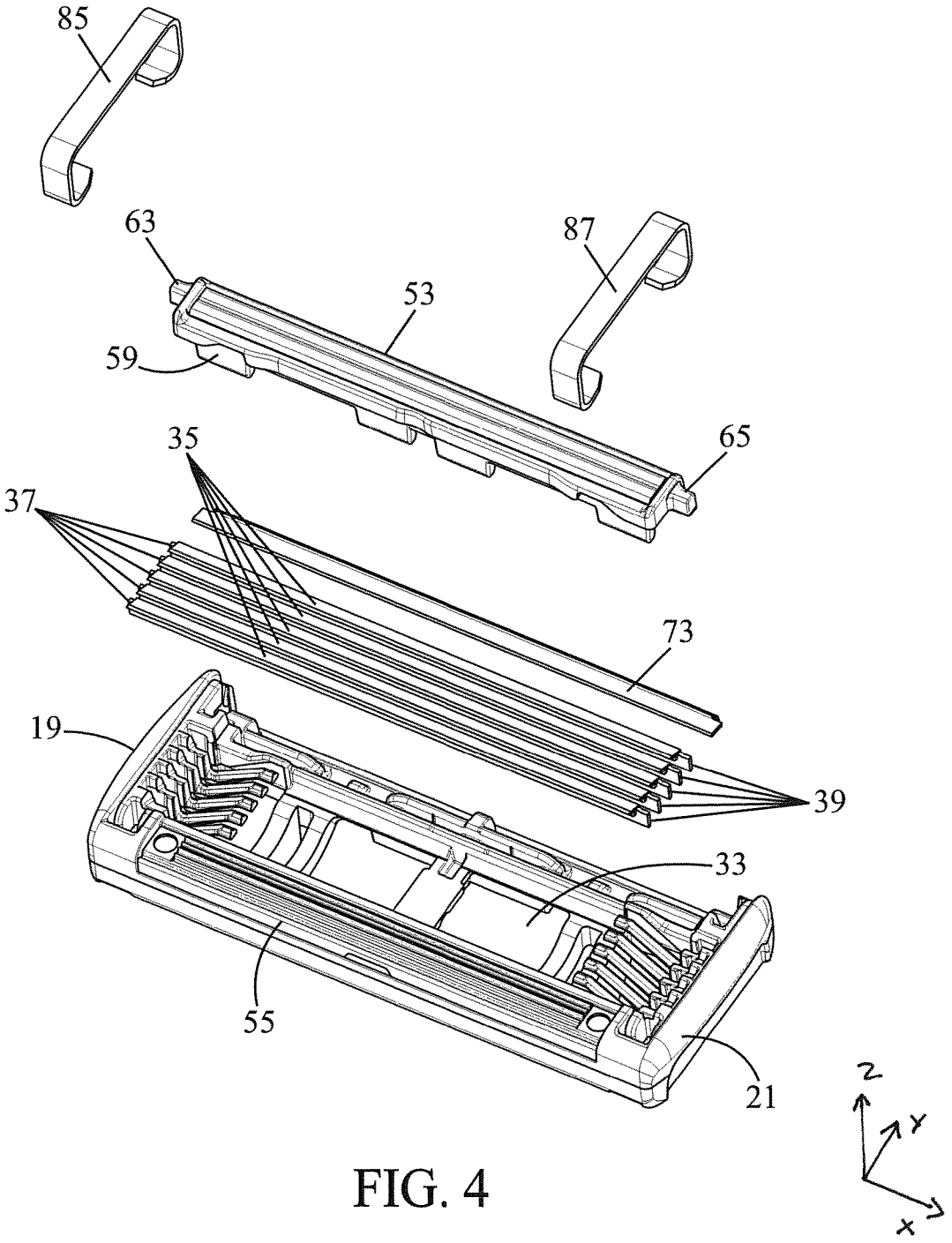
FIG. 4 is an exploded, perspective view of the shaving blade cartridge of FIG. 3*a*.
Figure 5:
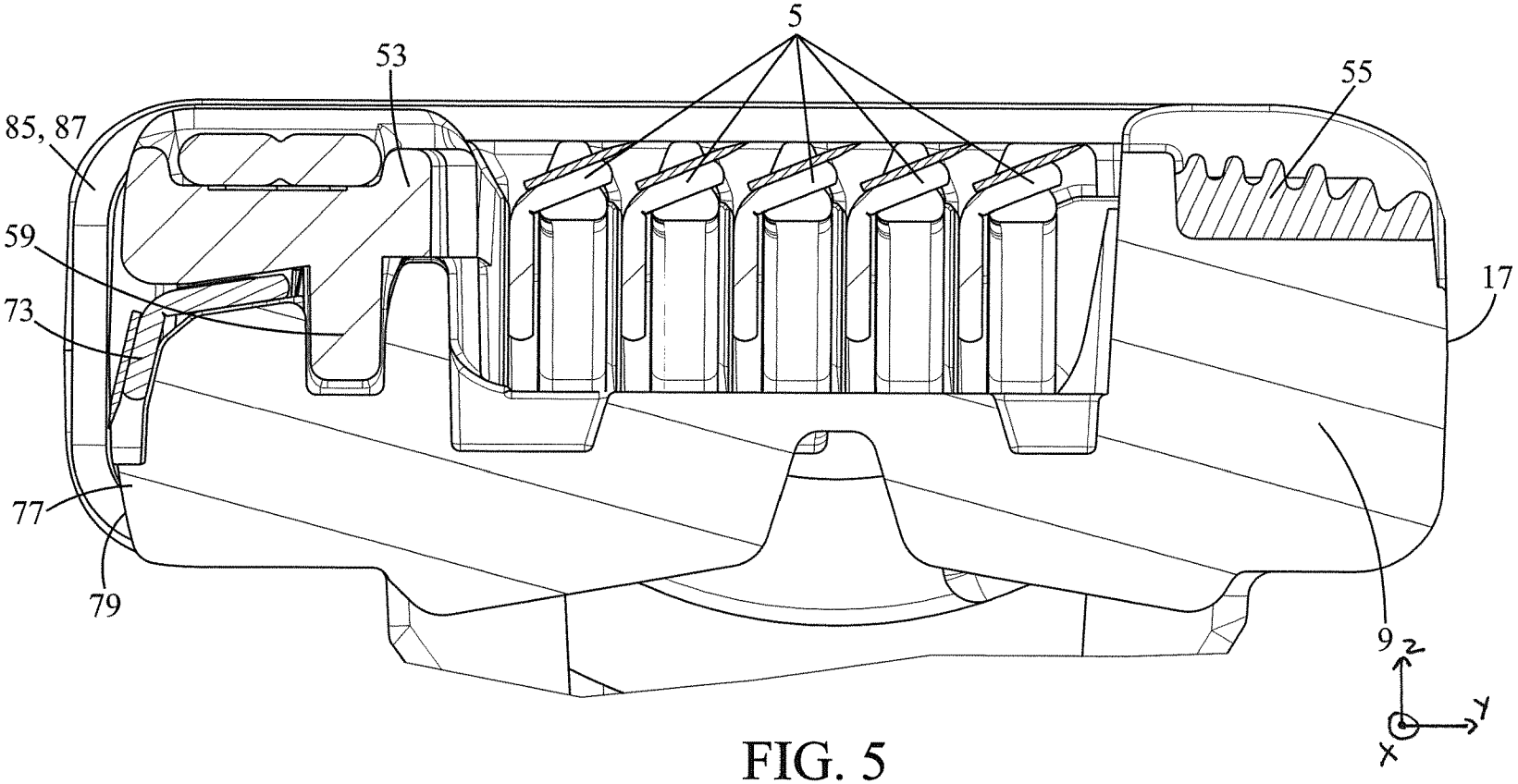
FIG. 5 is a side view of the shaving blade cartridge represented in FIG. 3*a*.
Figure 6B:
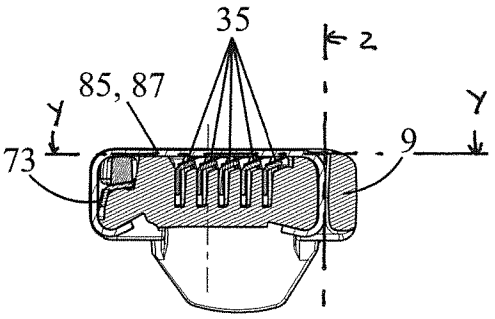
FIGS. 6*a*, 6*b*, 6*c* are side views and a top view of the shaving blade cartridge represented in FIG. 3*a*.
Figure 6A:
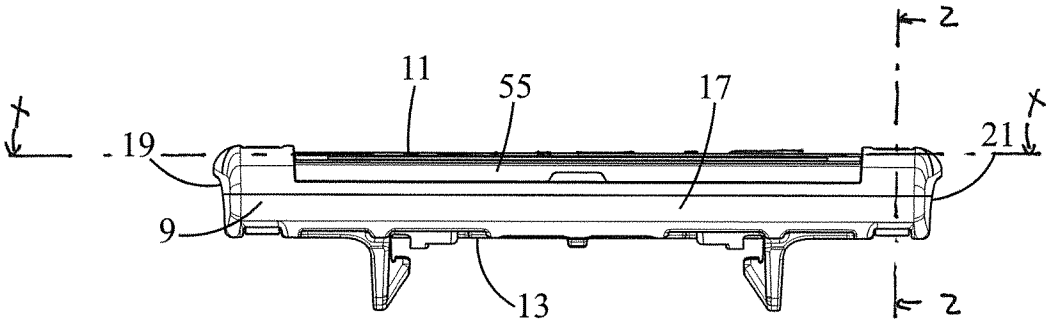
Figure 6C:
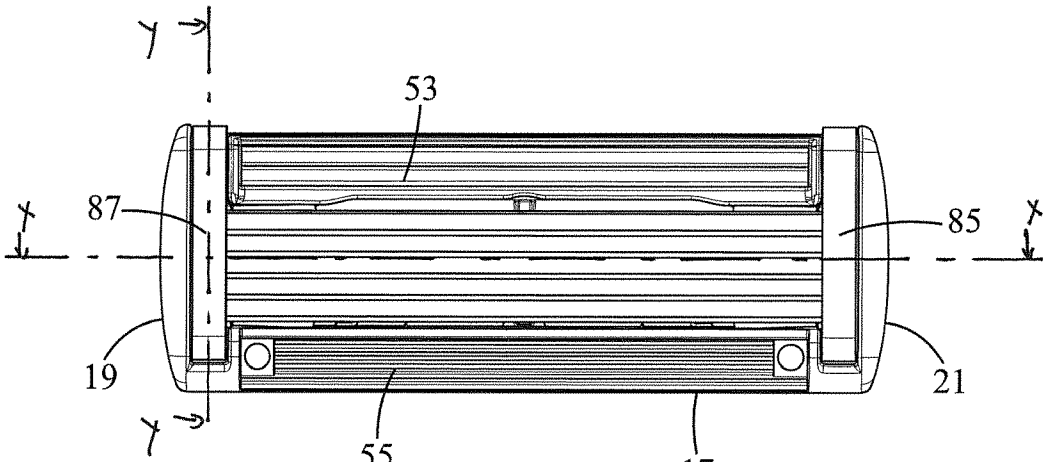

The housing 9 also includes a blade receiving section 33, as represented in FIGS. 3*a*, 3*b* and 4. The blade receiving section 33 or blade receiving area may have a general rectangular shape viewed from a top view. The blade receiving section 33 is arranged on the top side 11 of the housing 9. The blade receiving section 33 defines a recess and is adapted to receive at least one primary cutting blade 35. In other words, the shaving blade cartridge 1 includes at least one primary cutting blade 35. The primary cutting blade 35 is mounted on the housing between the first and second longitudinal sides 15, 17, and has a cutting edge 41.

As depicted on FIGS. 3*a*, 3*b*, 4, 5, 6*b*, 6*c* and 9, the shaving blade cartridge 1 includes five primary cutting blades. However, according to the present invention, the shaving blade cartridge 1 can include more or less than five primary cutting blades 35. For example the shaving blade cartridge 1 can include three primary cutting blades, or four primary cutting blades.

The primary cutting blades 35 are mounted in the housing 9 in the blade receiving section 33 between the first and second longitudinal sides 15, 17 of the housing 9 and between the first and second lateral sides 19, 21 of the housing 9. As shown in FIGS. 3*a*, 3*b*, 4, 5, 6*b*, 6*c* and 9, each primary cutting blade 35 extends longitudinally along a cutting blade axis. For example, the cutting blade axis C-C is parallel to the longitudinal axis X-X. Each primary cutting blade 35 includes a first and second end 37, 39 along the longitudinal axis X-X, and is directed toward the first longitudinal side 15. The first end 37 of the primary cutting blades 35 is directed toward the first lateral side 19 of the housing 9, whereas the second end 39 of the primary cutting blade 35 is directed toward the second lateral side 21 of the housing 9. Each primary cutting blade 35 includes a cutting edge 41. The cutting edge 41 extends along the cutting blade axis C-C. The cutting edge 41 of the primary cutting blade 35 is accessible at the top side 11 of the housing 9 to cut hair during the "main' or "primary" shaving.

Figure 10:
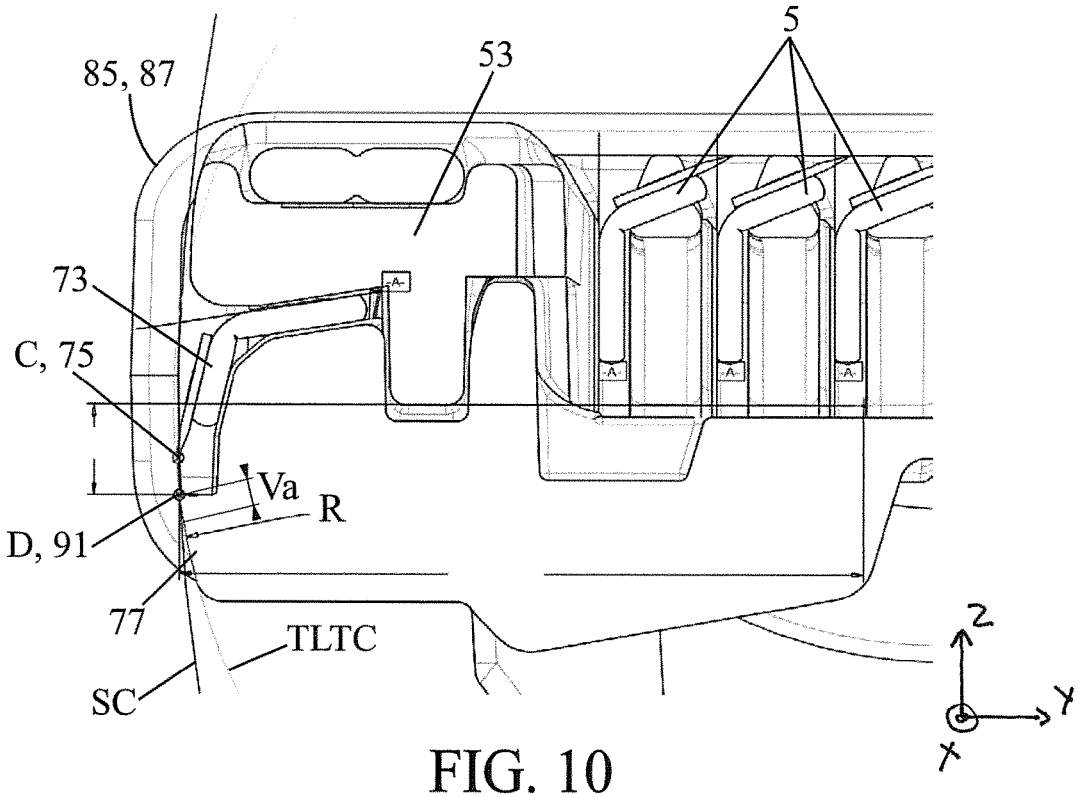
FIGS. 10 and 11 are side views of a detail of the shaving blade cartridge and of the shaving blade cartridge with a trimming curve represented according to an embodiment of the present invention.

For example, the primary cutting blades 35 are substantially L-shaped as represented on FIGS. 2 and 10. The primary cutting blades 35 thus have a cutting edge portion 43, a guided portion 45, and a bent portion 47 which is intermediate to the cutting edge portion 43 and the guided portion 45. The primary cutting edge portion 43 extends along a cutting edge portion axis. Advantageously, the cutting edge portion axis of all cutting blades 35 are positioned substantially parallel to each other.

Each primary cutting blade 35 can be freely mounted in the housing 9. More precisely, the primary cutting blades 35 are movably mounted in the blade receiving section 33. Each primary cutting blade 35 is, for example, supported by two elastic fingers. The elastic fingers can be molded as a single piece with the housing 9 and can extend in the blade receiving section 33 towards each other and upwardly from both lateral sides 19, 21 of the housing 9. As shown on FIGS. 3*a*, 3*b*, 6*b*, 9, the guided portions 45 of the primary cutting blades 35 are slidingly guided in slots 49 provided in the housing 9. For example, the primary cutting blade 35 can be provided with its cutting edge 41 fixed on a blade support 51 which includes the guided portion 45 and the bent portion 47. In this case the blade support 51 is carried by the elastic fingers.

However, in some others embodiments of the present invention (not shown on the figures) the primary cutting blades could be bent blades, as described for instance in patent application WO2013/050606, or curved blades.

According to the present invention, the shaving blade cartridge 1 includes a primary cap 53. The primary cap 53 is located rearward of the cutting edge 41. The primary cap 53 is located toward the first longitudinal side 15. The shaving blade cartridge 1 also includes a primary guard 55. The primary guard 55 is located forward of the cutting edge 41. The primary guard 55 is located toward the second longitudinal side 17.

Figure 9:
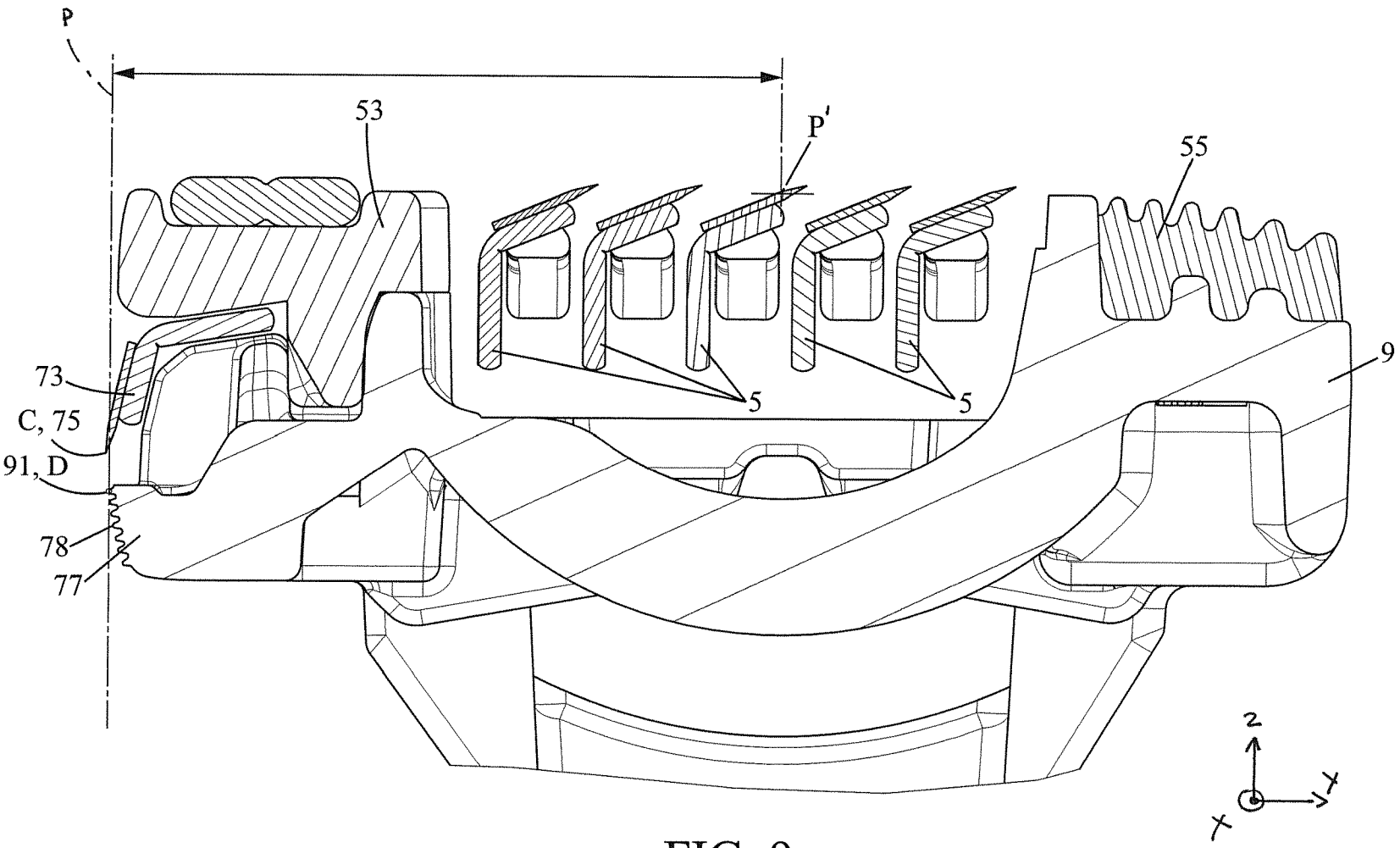
FIG. 9 is an embodiment of the shaving blade cartridge of the present invention including a trimming guard bar having fins.

As represented in FIGS. 3*a*, 3*b*, 9, the primary cap 53 is provided on a rear element 57. However, the primary cap 53 can be disposed by any manner knew from the person skilled in the art.

The rear element 57 can have a T-shape with two arms 59, 61. The first arm 59 extends transversally from the second arms 61. More precisely, the second arm 61 extends along a direction which is orthogonal to the direction of extension of the first arm 59. An end of the first arm 59 is fixed to a middle portion of the second arm 61.

The rear element 57 can extend along the longitudinal axis X-X between a first and a second free end 63, 65. For example, the first free end 63 of the rear element 57 is located toward the first end 37 of the primary cutting blade 35, whereas the second free end 65 of the rear element 57 is located toward the second end 39 of the primary cutting blade 35. The length of the rear element 57 is smaller than the length of the housing 9 along the longitudinal axis X-X.

The second arm 61 can be provided with the primary cap 53. The primary cap 53 is for example provided with a lubricating strip used during the "main" shaving. The second arm 61 extends outside of the housing 9. The second arm 61 extends on the top side 11 of the housing 9.

More particularly, the second arm 61 extends outside of the housing 9, and can form with the external surfaces of the housing 9, for example with the top side 11 of the housing 9, a continuous surface.

The first arm 59 can be press fitted in the housing. The first arm 59 includes a leg 59' which cooperates with a recess 67. The recess 67 is located between the primary cutting blade 35 and the first longitudinal side 15. More precisely, the first arm 59 can include a plurality of legs 59', each leg 59' cooperating with a dedicated recess 67. As represented in the FIGS. 4 and 5, the first arm 59 includes four legs 59' which are press-fitted into recesses 67 provided in the housing 9. For instance the number of recesses 67 can be at least two, for example, four. One leg 59' and one recess 67 form a press fit pair. Each leg 59' matches with one corresponding recess 67. Thus, four press fit pairs are formed, which increases the holding pressure of the rear element 57 into the housing 9. In others embodiments of the present invention, less or more press fit pairs can be provided. For example, the first leg could have only three legs, each of the three legs cooperating with one dedicated recess. In an alternative embodiment of the present invention, the recess can be provided on the rear element whereas the leg is provided on the housing. The first arm 59 can also be snap fitted in the housing.

A trimming element 73 is located between the rear element 57 and the housing 9 such as to allow a trimming shaving with the razor 3. The trimming element 73 can be sandwiched between the rear element 57 and the housing 9. More particularly, the rear element 57 and the housing define a recess or a slot 74 in which the trimming element 73 extends and is fastened by the rear element 57 being fitted in the housing 9. The trimming element 73 can extend along the longitudinal axis X-X.

The trimming element 73 has a trimming edge 75. The trimming edge 75 and the cutting edge 41 of the primary cutting blade 35 are opposite. In other words, the trimming edge 75 and the cutting edge 41 are facing opposite directions. For instance, the trimming edge 75 is directed toward the bottom side 13 of the housing 9, whereas the cutting edge is directed beyond the top side 11 of the housing 9.

The trimming element 73 includes a trimming blade 81. The trimming element 73 can be similar to the primary cutting blade 35. For example, the trimming element 73 can have the same shape than the primary cutting blade 35.

In a possible embodiment of the present invention, the trimming blade 81 can have another shape, or other dimensions than the primary blade. It can especially have a shorter blade length. The trimming blade allows a better shaving of skin areas constricted by adjacent protruding facial features, e.g. skin areas situated under the nose, near the ears, and the same. Thus the trimming shaving is in particular the shaving of skin areas constricted by adjacent protruding facial features with a trimming element. The trimming shaving allows a precision shaving.

The trimming element 73 includes a trimming blade support 83 and a trimming blade 81. The trimming blade 81 includes the trimming edge 75, and the trimming blade 81 is supported by the trimming blade support 83. The trimming blade support 83 extends in the slot 74 defined by the rear element 57 and the housing 9. The trimming blade support 83 is fastened to the housing 9 for example with the snap fitting of the rear element 57 into the housing 9. The trimming blade support 83 is thus sandwiched between the rear element 57 and the housing.

The trimming blade 81 can also be retained on the housing 9 by a retainer 85. The trimming blade 81 can also be retained on the housing 9 by two retainers 85, 87. For example, the retainer 85, 87 (represented in FIG. 4 or in FIG. 5, or FIG. 6*c*) can retain either the primary cutting blades 35 or the trimming element 73, or both the primary cutting blades 35 and the trimming element 73.

The trimming element 73 could be a bent blade, as described for instance in patent application WO2013/050606, or a curved blade.

The trimming blade 81 extends along a trimming axis. The trimming axis can coincide with the longitudinal axis X-X.

A portion of the housing 9 or an element provided on the housing is located forward of the trimming edge 75. The housing 9 is provided with a trimming guard bar 77.

The trimming guard bar 77 is located forward of the trimming edge 75. The trimming guard bar 77 can comprise a leading surface located forward the trimming edge 75.

Figure 7:
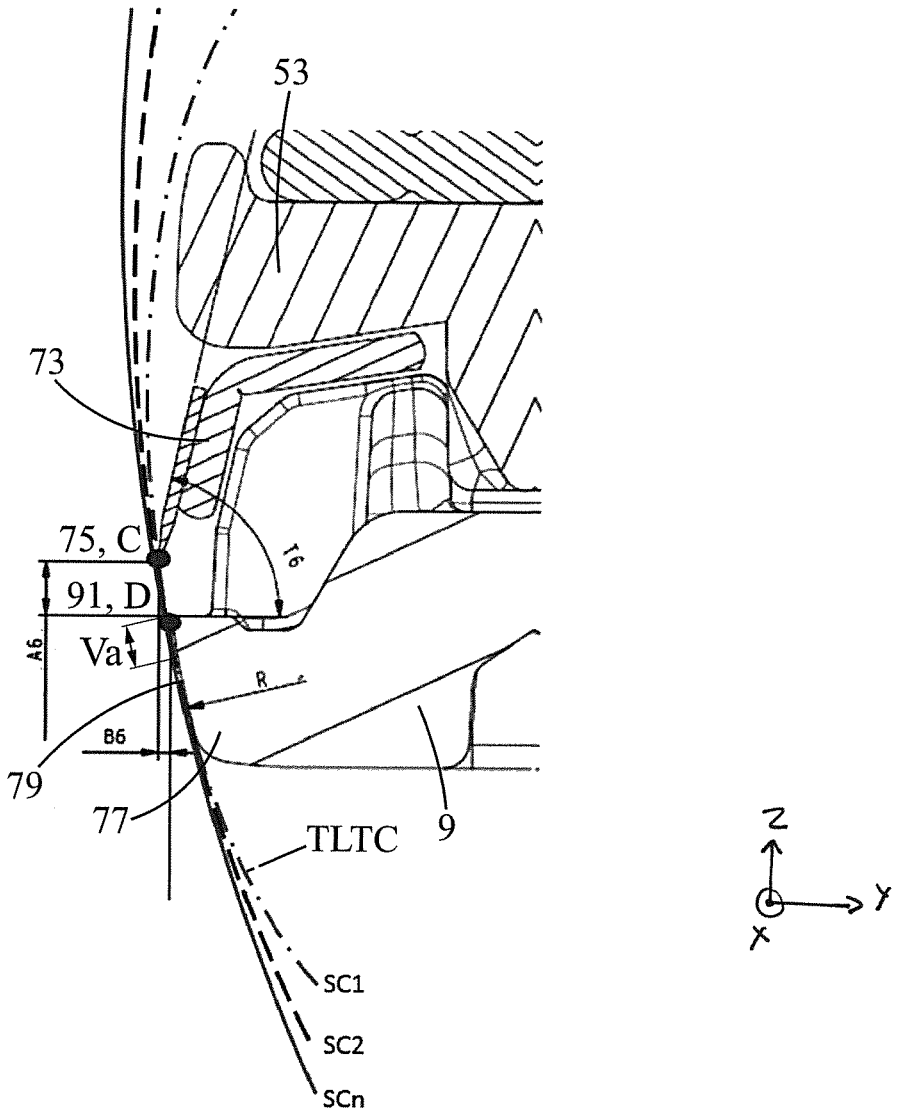
FIG. 7 is a detailed view of the shaving blade cartridge of FIG. 3*a* in which different trimming curves have been represented.

The trimming guard bar 77 can be provided with a curved external surface 79 (see for example FIG. 7). The curved external surface 79 is destined to face the skin of the user. The curved external surface 79 can have a curvature which is between 3 mm (millimeters) and 8 mm. For example the curvature can be 6 mm (millimeters) and 8 mm. Alternately, the curved external surface 79 can have a curvature in the order of 7.5 mm, or 7.59 mm or 7.00 mm.

The trimming guard bar 77 can be provided with projections or fins 78, as represented in FIG. 9. The trimming guard bar 77 can also be without any projection (protrusion or groove). The trimming guard bar can be provided with a smooth surface. The trimming guard bar can be straight, or not curved.

The trimming guard bar 77 is provided with a trimming guard bar edge 91. The trimming guard bar edge 91 can be an apex of the trimming guard bar 77. The trimming guard bar edge 91 can be the edge of the trimming guard bar 77 which is oriented toward the trimming edge 75. The trimming guard bar edge 91 can be the edge of the trimming guard bar 77 which projects the most toward a direction according to arrow F represented in FIG. 3*a* (in other words, in a direction which is opposite to the housing 9). The trimming guard bar edge 91 can be the edge of the trimming guard bar 77 which is the highest point of the trimming guard bar 77 according to the lateral axis Z-Z toward the top side 11. The trimming guard bar edge 91 is the left-most point of the trimming guard bar when considering that the primary cutting blades 35 are on the right of that trimming guard bar 77 (see FIGS. 3*a*, 3*b*, 5, 6*b*, 9 for instance). When the trimming guard bar 77 is provided with projections, it means that the trimming guard bar edge 91 is the point on the trimming guard bar 77 that is located the farthest from the pivot axis V (see FIG. 9), if the shaving blade cartridge 1 is movable with regard to the handle 7. If the shaving blade cartridge is not movable with regard to the handle 7, the trimming guard bar edge 91 is the point on the trimming guard bar 77 that is located the farthest from the second longitudinal side 17 along the lateral axis Y-Y.

The trimming edge 75 can have a positive location, such as illustrated in FIG. 3*a*. The trimming edge 75 can also have a negative location (see FIG. 3*b*). In other words, the trimming edge can be on one side of the trimming guard bar 77 or on the other side with regard to the trimming guard bar 77. The trimming edge 75 can project with regard to the trimming guard bar 77 toward a direction opposite to the direction of the second longitudinal side 17, such as represented in FIG. 3*a*. In other words, the trimming edge 75 projects forward (along arrow F in FIG. 3*a*) the trimming guard bar edge 91. FIG. 3*a* shows a plane parallel to the Z axis which passes through the trimming guard bar edge 91. In this figure, the trimming blade edge has a positive location, i.e. the trimming blade edge 75 is located on the left side of the plane P parallel to the Z axis which passes through the trimming guard bar edge 91. In other words, the trimming blade edge 75 is located on one side of the plane P parallel to the Z axis which passes through the trimming guard bar edge 91, whereas the housing 9 is located on the other side. In this case the trimming blade 81 has a positive location. The trimming edge 75 can also be arranged behind the trimming guard bar 77, such as represented in FIG. 3*b*. In other words, the trimming edge 75 does not project forward of (along arrow F in FIG. 3*a*) the trimming guard bar edge 91. The trimming edge 75 is behind the trimming guard bar edge 91. FIG. 3*b* shows a plane parallel to the Z axis which passes through the trimming guard bar edge 91. In this figure, the trimming blade edge has a negative location, for example the trimming blade edge 75 is located on the right side of the plane P parallel to the Z axis which passes through the trimming guard bar edge 91. In other words, the trimming blade edge 75 is located on the same side of the plane P parallel to the Z axis which passes through the trimming guard bar edge 91 than the housing 9. In this case, the trimming blade has a negative location.

According to the present invention, no trailing surface for the trimming blade 73 is provided on the housing 9.

Figure 8:
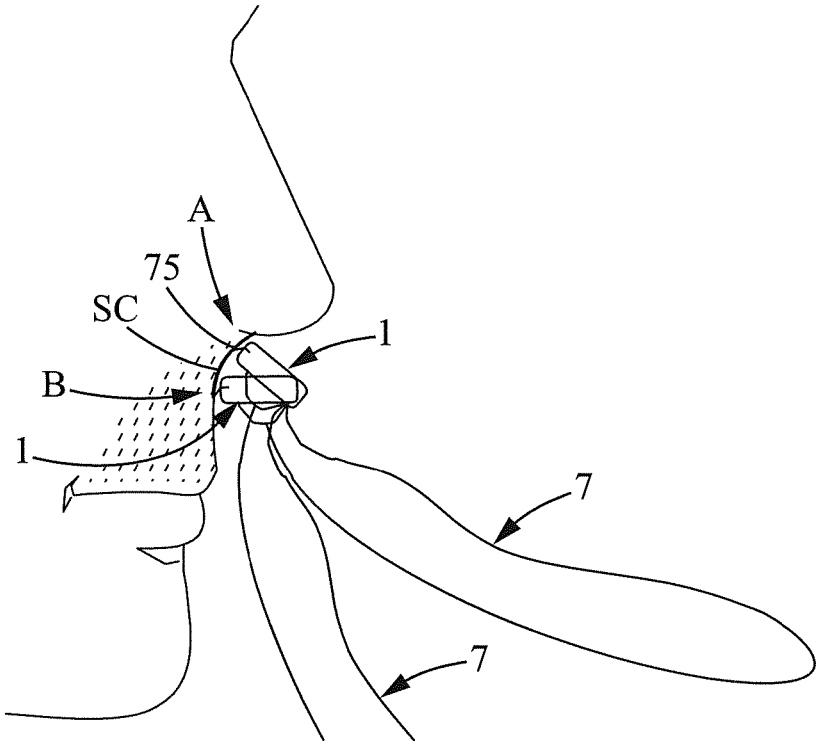
FIG. 8 is a schematic drawing of a user using a shaver according to the present invention.

During trimming, the user can orient the shaver of the present invention such that the trimming occurs according to trimming curve SC which corresponds to the skin area to be trimmed, as represented in FIG. 8. FIG. 8 shows a user using the shaving blade cartridge 1. Depending on the area to be trimmed, the user may have to follow a curve to precisely trim.

The trimming curve SC passes by a first point C which is the trimming edge 75. The trimming curve SC passes also by a second point D which is the highest point of the trimming guard bar 77. In other words, the second point D corresponds to the trimming guard bar edge 91. The absence of both a leading and trailing surface allows the user having such a shaving blade cartridge to use the trimming element (and more precisely the trimming blade) with a motion which is in accordance with a trimming curve which fits the skin, as represented in FIG. 8. In more detail, the absence of the trailing surface for the trimming blade 73 allows the user to easily follow any face skin curve (of any radius) with the required precision.

The trimming curve SC is defined as any curve passing through the two points C and D as represented in FIGS. 7, 10, 11, 12, 13. An example of three shaving curves SCi, {i=1, 2, . . . n} is given in FIG. 7. The arc C-D can follow the curvature of the skin such to improve the trimming capability of the shaver. The shape of the shaving blade cartridge 1, and more particularly the disposition of the trimming edge 73 and of the trimming guard bar 77 allows the definition of a theoretical limit trimming curve TLTC.

The shape and the position of the theoretical limit trimming curve TLTC can depend on:

- the position of the points C and D
- the radius of the trimming guard bar 77 (if the trimming guard bar is curved)
- the center of the trimming guard bar 77 (if the trimming guard bar is curved).

The theoretical limit trimming curve TLTC corresponds to the minimum trimming curve SC that a user may use. The theoretical limit curve TLTC is limited and defined by the shape of the cartridge itself and represents the physical boundary of the trimming curve SC. The maximum trimming curve that a user may use has not a zero-curvature.

The trimming guard bar 77 is designed so that the theoretical limit trimming curve TLTC (which passes through points C and D) encloses the trimming guard bar (in other words, the trimming guard bar is inside the theoretical limit trimming curve which is then concave seen from the trimming guard bar). The trimming guard bar 77 can slope away from the trimming guard bar edge 91 toward the bottom side 13. The trimming guard bar 77 can slope away from the trimming guard bar edge 91 toward the bottom side 13 and toward the second longitudinal side 17.

The trimming guard bar 77 includes an area in the vicinity of the trimming guard bar edge 91, i.e. at a short distance from the trimming guard bar edge 91. The area designed by the term "in the vicinity of the trimming guard bar edge" can be understood like an area extending from the trimming guard bar edge 91 to a distance from the trimming guard bar edge 91 between 5% and 20%, and for example to 10% of the orthogonally projected length of the trimming guard bar 77 along the lateral axis Z-Z.

More particularly, the theoretical limit trimming curve TLTC can be tangent to the trimming guard bar 77, for example in the vicinity of the trimming guard bar edge 91. Thus, all trimming curves pass by points C and D and enclose the trimming guard bar 77. As best seen in FIGS. 10, 11, 12, 13, the trimming curve SC can be a portion of a circle or an ellipse and the trimming guard bar 77 is enclosed inside the circle or the ellipse. The circle or ellipse may have different center, depending on the shape of the skin area to be trimmed. From the trimming curve SC, it is possible to define either a circle or an ellipse which will be around the trimming guard bar 77. The trimming guard bar 77 is enveloped by the circle or the ellipse. Independent of the shape of the guard bar, meaning if it has bumps, cavities or grooves or any other protrusions or is a smooth surface, the trimming curve SC (and the circle or the ellipse defined by the trimming curve) will encompass the geometry of the trimming guard bar 77 inside its perimeter. In other words, the trimming guard bar does not project outside of the ellipse or circle defined by the theoretical limit trimming curve, and thus by any trimming curve SC.

As represented in FIG. 10, the radius, R, of the trimming guard bar, at least in the vicinity of the trimming guard bar edge 91, is R being between about 7.3 mm and about 7.8 mm, for example R is about 7.59 mm. The FIG. 10 shows the theoretical limit trimming curve TLTC and a possible trimming curve.

The shaving blade cartridge 1 can have a general square shape and have the following dimensions:

- width according to the transversal axis Y-Y (from the trimming guard bar edge to the first longitudinal side 15) between about 15 mm and about 16 mm, for example 15.37 mm;
- length according to the longitudinal axis X-X (between first and second lateral sides 19, 21) between about 43 and about 44 mm, for example 43.6 mm;
- height according to the lateral axis Z-Z (from the bottom side to the top side) between about 5 millimeters and about 6 millimeters; for example 5.35 mm;

The trimming guard bar edge 91 can be located at a distance between about 3 mm and about 4 mm from the top side 11 of the housing 9 along the lateral axis Z-Z. The trimming edge 75 can be located at a distance of approximately 0.11 mm from the trimming guard bar edge 91 along the transversal axis Y-Y and at a distance of approximately 0.41 mm along the lateral axis Z-Z.

The relative position of the trimming guard bar edge 91 and the trimming edge 75 can be different than those disclosed above. Moreover, the dimensions of the housing 9 of the shaving blade cartridge 1 can be also different than those disclosed above.

Figure 11:
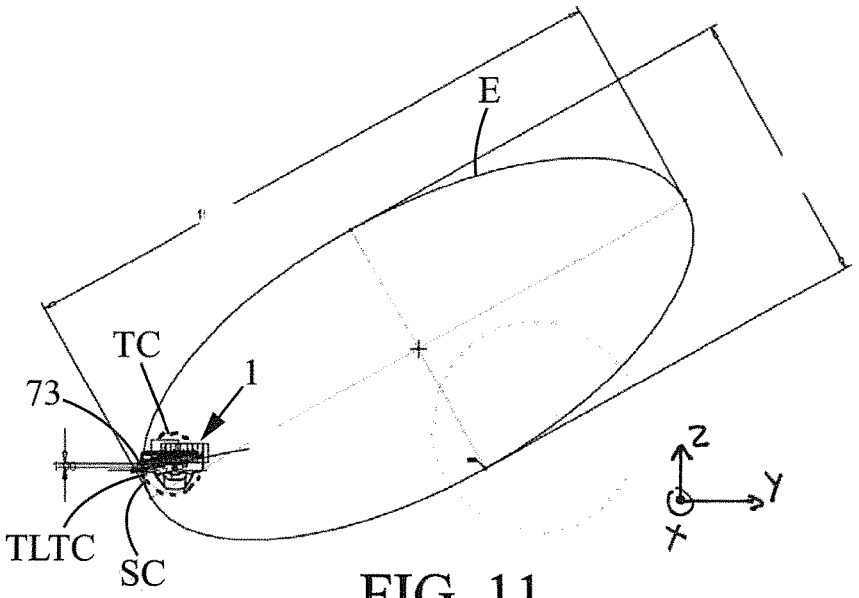

In FIG. 10 for example, the trimming guard bar 77 is sensibly curved and has a curvature of 7.59 mm. The center of the theoretical circle TC (see FIG. 11) defined by the theoretical limit trimming curve TLTC is positioned between about 7.3 millimeters and about 7.7 millimeters along the transversal axis Y-Y toward the second longitudinal side 17 from the trimming guard bar edge and between about 0.8 and about 1.2 millimeters (mm) along the lateral axis Z-Z toward the top side 11 from the trimming guard bar edge 91. For example the center of the theoretical circle TC (see FIG. 11) defined by the theoretical limit trimming curve TLTC can be positioned 7.52 millimeters (mm) along the transversal axis Y-Y toward the second longitudinal side 17 from the trimming guard bar edge and about 1.00 millimeters (mm) along the lateral axis Z-Z toward the top side 11 from the trimming guard bar edge 91. The trimming curve SC can be any curve which is outside the theoretical limit trimming curve TLTC or can coincide with the theoretical limit trimming curve TLTC. FIG. 10 represents a possible trimming curve SC. FIG. 11 represents the theoretical limit trimming curve shown in FIG. 10 and the theoretical circle TC defined by the theoretical limit trimming curve TLTC, as well as a trimming curve SC (disposed outside the theoretical circle) and the ellipse E defined by the trimming curve.

Figure 12:
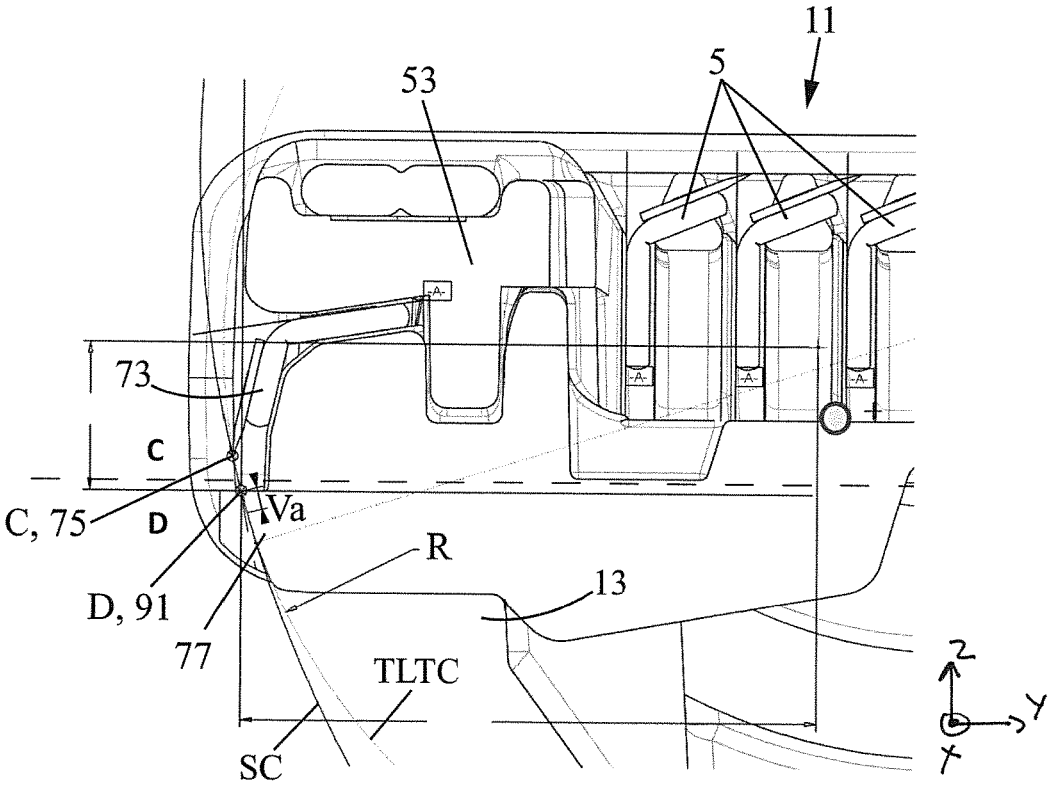
FIGS. 12 and 13 are side views of a detail of the shaving blade cartridge and of the shaving blade cartridge with a trimming curve represented according to another embodiment of the present invention.
Figure 13:
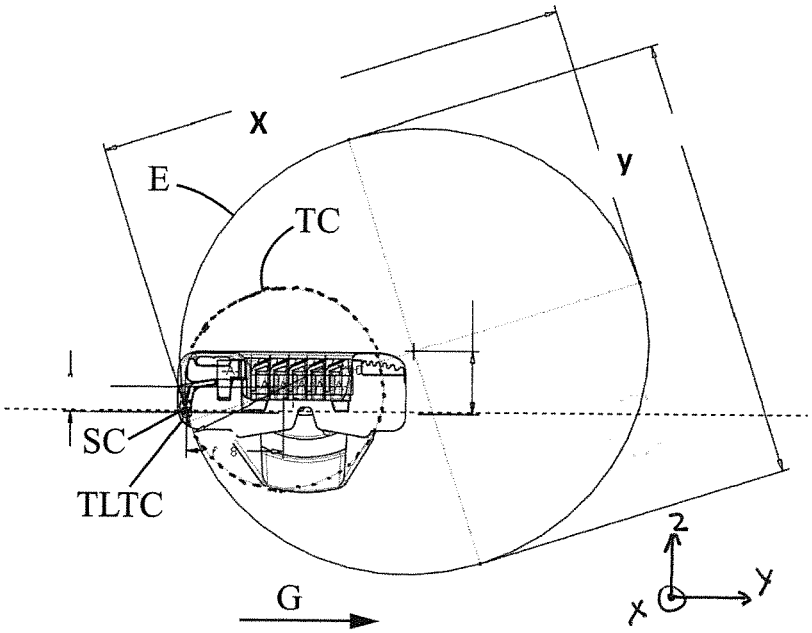

FIGS. 12 and 13 show another embodiment of the present invention of a trimming curve SC and the theoretical limit trimming curve TLTC. In this example, the trimming guard bar 77 is sensibly curved and has a radius R of about 7 millimeters. The center of the theoretical circle TC defined by the theoretical limit trimming curve TLTC is positioned between about 6.5 and about 7 millimeters (mm) along the transversal axis Y-Y toward the second longitudinal side 17 (arrow G) from the trimming guard bar edge and between about 1.5 and about 2 millimeters (mm) along the lateral axis Z-Z toward the top side 11 from the trimming guard bar edge 91. For example, the center of the theoretical circle TC defined by the theoretical limit trimming curve TLTC is positioned 6.78 millimeters (mm) along the transversal axis Y-Y toward the second longitudinal side 17 (arrow G) from the trimming guard bar edge and about 1.74 millimeters (mm) along the lateral axis Z-Z toward the top side 11 from the trimming guard bar edge 91. The trimming curve SC can be any curve which is outside the theoretical limit trimming curve TLTC or on the theoretical limit trimming curve. FIG. 12 represents a possible trimming curve SC. FIG. 13 represents the theoretical limit trimming curve TLTC shown in FIG. 12 and the theoretical circle TC defined by the theoretical limit trimming curve, as well as a trimming curve SC (disposed outside the theoretical circle) and the circle or ellipse E defined by the trimming curve SC.

The present invention is not limited to the embodiments of FIGS. 10, 11 and 12, 13.

The shaving blade cartridge includes a housing. The housing extends along a longitudinal axis X-X. The housing has a top side. The housing has a bottom side. The bottom side is opposite the top side. The housing includes first and second longitudinal sides 15, 17. The longitudinal sides each extend longitudinally along the longitudinal axis X-X between the top and bottom sides 11, 13. The shaving blade cartridge includes a primary cutting blade 35. The primary cutting blade 35 is mounted on the housing 9 between the first and second longitudinal sides 11, 13. The primary cutting blade has a cutting edge 41. The shaving blade cartridge includes a primary cap 53. The primary cap 53 is located rearward of the cutting edge 41. The shaving blade cartridge includes a trimming element 73. The trimming element is mounted on the housing 9. The trimming element includes a trimming edge 75. The trimming edge and the cutting edge 41 are opposite. The shaving blade cartridge includes a trimming guard bar. The trimming guard bar is provided on the housing. The trimming guard bar is forward of the trimming edge 75. The trimming guard bar includes a trimming guard bar edge D. The shaving blade cartridge includes a theoretical limit trimming curve. The theoretical limit trimming curve pass by the trimming edge and the trimming guard bar edge. The theoretical limit trimming curve is tangential to the trimming guard bar in the vicinity of the trimming guard bar edge. The trimming edge C, the trimming guard bar edge D and the tangent to the trimming guard bar in the vicinity of the trimming guard bar edge D define a theoretical limit trimming curve which is concave viewed from the trimming guard bar. The trimming guard bar is disposed behind the theoretical limit trimming curve toward the second longitudinal side 17. The trimming guard bar is disposed tangential to the theoretical limit trimming curve toward the second longitudinal side 17. The trimming guard bar does not project beyond the theoretical limit trimming curve in a direction opposite of the direction of the second longitudinal side 17.

In an embodiment of the present invention, which can be additional or not, the shaving blade cartridge includes a housing. The housing extends along a longitudinal axis X-X. The housing has a top side. The housing has a bottom side. The bottom side is opposite the top side. The housing includes first and second longitudinal sides 15, 17. The longitudinal sides each extend longitudinally along the longitudinal axis X-X between the top and bottom sides 11, 13. The shaving blade cartridge includes a primary cutting blade 35. The primary cutting blade 35 is mounted on the housing 9 between the first and second longitudinal sides 11, 13. The primary cutting blade has a cutting edge 41. The shaving blade cartridge includes a primary cap 53. The primary cap 53 is located rearward of the cutting edge 41. The shaving blade cartridge includes a trimming element 73. The trimming element is mounted on the housing 9. The trimming element includes a trimming edge 75. The trimming edge 75 and the cutting edge 41 are opposite. The shaving blade cartridge includes a trimming guard bar. The trimming guard bar is provided on the housing. The trimming guard bar is forward of the trimming edge 75. The trimming guard bar includes a trimming guard edge D. The trimming guard bar does not intersect the plane passing by the trimming edge and the trimming guard bar edge D. The trimming guard bar is located behind the plane passing by the trimming edge and the trimming guard bar edge D toward the second longitudinal side 17.

The primary cap is behind the theoretical limit trimming curve toward the second longitudinal side 17. The primary cap is behind the plane passing by the trimming edge and the trimming guard bar edge toward the second longitudinal side 17.

The theoretical limit trimming curve is tangential to the guard bar in the vicinity of the trimming guard bar edge 91, for example the theoretical limit trimming curve is tangential to the guard bar along a distance from the trimming guard bar edge between 5% and 20%, and for example to 10% of the projected length of the trimming guard bar along the lateral axis Z-Z. The projected length of the trimming guard bar 77 on the lateral axis Z-Z is its perpendicular projection on the lateral axis Z. The area defined by the term in the vicinity of the trimming guard bar edge 91 is represented in FIGS. 7, 10, 12 by the reference Va.

The trimming guard bar is sensibly curved. The curvature of the trimming guard bar is included between about 6 millimeters and about 8 millimeters. The curvature of the theoretical limit trimming curve can be substantially equal to the curvature of the trimming guard bar.

The trimming guard bar can also have other shapes. The theoretical limit trimming curve is a portion of a circle or an ellipse.

In the description above, the theoretical limit trimming curve is defined with regard to the trimming guard bar, the trimming guard bar edge and the trimming edge. The primary cap edge is the edge of the cap which can be an apex of the primary cap. The primary cap edge can be the edge of the primary cap which is oriented opposite the main blade edge(s). The primary cap edge can be the edge of primary cap which projects the most in a direction opposite to the second longitudinal side 17. The primary cap edge can be the edge of the primary cap which is the highest point of the primary cap according to the transversal axis Y-Y. The primary cap edge is the leftmost point of the primary cap along arrow F.

The shaving blade cartridge includes a housing. The housing extends along a longitudinal axis X-X. The housing has a top side. The housing has a bottom side. The bottom side is opposite the top side. The housing includes first and second longitudinal sides 15, 17. The longitudinal sides each extend longitudinally along the longitudinal axis X-X between the top and bottom sides 11, 13. The shaving blade cartridge includes a primary cutting blade 35. The primary cutting blade 35 is mounted on the housing 9 between the first and second longitudinal sides 11, 13. The primary cutting blade has a cutting edge 41. The shaving blade cartridge includes a primary cap 53. The primary cap 53 is located rearward of the cutting edge 41. The shaving blade cartridge includes a trimming element 73. The trimming element is mounted on the housing 9. The trimming element includes a trimming edge 75. The trimming edge and the cutting edge 41 are opposite. The primary cap 53 includes a primary cap edge. The shaving blade cartridge includes a theoretical limit trimming curve. The theoretical limit trimming curve encompasses the primary cap. The theoretical limit trimming curve encompasses the primary cap edge. The primary cap is disposed behind the theoretical limit trimming curve toward the second longitudinal side 17. In some cases, the primary cap is disposed tangential to the theoretical limit trimming curve toward the second longitudinal side 17. The primary cap does not project beyond the theoretical limit trimming curve in a direction opposite of the direction of the second longitudinal side 17.

In an embodiment of the present invention, which can be additional or not, the shaving blade cartridge includes a housing. The housing extends along a longitudinal axis X-X. The housing has a top side. The housing has a bottom side. The bottom side is opposite the top side. The housing includes first and second longitudinal sides 15, 17. The longitudinal sides each extend longitudinally along the longitudinal axis X-X between the top and bottom sides 11, 13. The shaving blade cartridge includes a primary cutting blade 35. The primary cutting blade 35 is mounted on the housing 9 between the first and second longitudinal sides 11, 13. The primary cutting blade has a cutting edge 41. The shaving blade cartridge includes a primary cap 53. The primary cap 53 is located rearward of the cutting edge 41. The shaving blade cartridge includes a trimming element 73. The trimming element is mounted on the housing 9. The trimming element includes a trimming edge 75. The trimming edge and the cutting edge 41 are opposite. The shaving blade cartridge is such that it is free of material rearward the trimming blade edge in order to allow a trimming which is not limited by a contact of the skin with the housing rearward the trimming edge. The primary cap 53 does not disturb the theoretical limit trimming curve TLTC. The theoretical limit trimming curve TLTC and therefore the trimming curves encompass the primary cap 53 geometry inside its perimeter.

The housing can be made of plastic. The blades (primary cutting blades and/or trimming blade) can be made of metal possibly coated to improve the blade edge wear resistance.

The blades (main and/or trimming) can be retained in the housing by two clips. The main blades can be movable.

As understood by a person of ordinary skill in the art, the word "about" as used in the present description and the claims includes a tolerance of +/−0.5 millimeters.

In some embodiments of the present, a person of ordinary skill in the art might also use one or more of the above-mentioned features. These features can be used alone or combined together of any manner known by the person skilled in the art, unless it is otherwise specified.

The invention claimed is:

1. A shaving blade cartridge comprising:

a housing extending along a longitudinal axis having a top side and a bottom side opposite the top side, and first and second longitudinal sides each extending longitudinally along the longitudinal axis between the top and bottom sides;

a primary cutting blade mounted on the housing between the first and second longitudinal sides, the primary cutting blade having a cutting edge;

a primary cap, the primary cap being located rearward of the cutting edge;

a trimming element mounted on the housing, the trimming element including a trimming edge, the trimming edge and the cutting edge being opposite;

a trimming guard bar is provided on the housing and including a trimming guard bar edge, the trimming guard bar edge corresponding to an intersection between an apex of the trimming guard bar and an upper horizontal surface of the trimming guard bar, the primary cap, the trimming edge, and the trimming guard bar being positioned along a vertical plane transverse to the longitudinal axis, wherein the trimming edge, the trimming guard bar edge, and an external surface of the trimming guard bar define a theoretical limit trimming curve which is concave when viewed in relation to the trimming guard bar, and wherein the theoretical limit trimming curve passes through a first point defined by the trimming edge and a second point defined by the trimming guard bar edge, such that the trimming guard bar and the primary cap are disposed behind and do not project beyond the theoretical limit trimming curve.

2. The shaving blade cartridge according to claim 1, wherein the primary cap is behind the theoretical limit trimming curve toward the second longitudinal side.

3. The shaving blade cartridge according to claim 1, wherein the theoretical limit trimming curve is tangential to the guard bar in the vicinity of the trimming guard bar edge along a distance from the trimming guard bar edge between 5% and 20% of an orthogonally projected length of the trimming guard bar.

4. The shaving blade cartridge according to claim 1, wherein the trimming guard bar is provided with a curved external surface, the curved external surface being destined to face the skin of the user, wherein the curved external surface has a curvature which is between about 3 millimeters and about 8 millimeters.

5. The shaving blade cartridge according to claim 4, wherein the curved external surface has a curvature which is between about 6 millimeters and about 8 millimeters.

6. The shaving blade cartridge according to claim 1, wherein the theoretical limit trimming curve is a portion of a circle or an ellipse.

7. The shaving blade cartridge according to claim 6, wherein the curvature of the theoretical limit trimming curve is between about 6 millimeters and about 8 millimeters.

8. The shaving blade cartridge according to claim 1, wherein the trimming element includes a trimming blade support and a trimming blade, the trimming blade including the trimming edge, and the trimming blade being supported by the trimming blade support.

9. The shaving blade cartridge according to claim 1, further comprising two retainers retaining the blades on the housing.

10. The shaving blade cartridge according to claim 1, wherein the trimming guard bar includes fins.

11. The shaving blade cartridge according to claim 1, wherein the trimming guard bar includes a smooth surface.

12. The shaving blade cartridge according to claim 1, wherein the trimming guard bar is curved and has a radius between about 7.3 and about 7.8 millimeters, wherein the theoretical limit trimming curve is a portion of a theoretical circle, wherein a center of the theoretical circle is positioned between about 7.3 and about 7.7 millimeters along a transversal axis toward the second longitudinal side from the trimming guard bar edge and between about 0.8 and about 1.2 millimeters along a lateral axis toward the top side from the trimming guard bar edge.

13. The shaving blade cartridge according to claim 1, wherein the trimming guard bar is curved and has a radius of about 7 millimeters, wherein the theoretical limit trimming curve is a portion of a theoretical circle, wherein a center of the theoretical circle is positioned between about 6.5 and about 7 millimeters along a transversal axis toward the second longitudinal side from the trimming guard bar edge and between about 1.5 and about 2 millimeters along a lateral axis toward the top side from the trimming guard bar edge.

14. The shaving blade cartridge according to claim 1, wherein the trimming element is sandwiched between the housing and the primary cap.

15. A shaver comprising a handle and a shaving blade cartridge according to claim 1, the shaving blade cartridge being connected to the handle.

* * * * *